US006474209B1

(12) United States Patent
Granger

(10) Patent No.: US 6,474,209 B1
(45) Date of Patent: Nov. 5, 2002

(54) AUTOMATIC OR SEMI AUTOMATIC WIPING MATERIAL AND TOILET PAPER DISPENSER

(76) Inventor: Maurice Granger, 17 Rue Marcel Pagnol, 42270 Saint Priest en Jarez (FR)

( * ) Notice: Subject to any disclaimer, the term of this patent is extended or adjusted under 35 U.S.C. 154(b) by 0 days.

(21) Appl. No.: 09/673,408

(22) PCT Filed: Apr. 1, 1999

(86) PCT No.: PCT/FR99/00754

§ 371 (c)(1),
(2), (4) Date: Jan. 17, 2001

(87) PCT Pub. No.: WO99/56605

PCT Pub. Date: Nov. 11, 1999

(30) Foreign Application Priority Data

May 4, 1998 (FR) ..... 98 05866

(51) Int. Cl.[7] ..... B26D 7/00; G07F 11/66; B65H 19/00

(52) U.S. Cl. ..... 83/649; 221/30; 242/560

(58) Field of Search ..... 83/649, 650, 949, 83/335, 337; 242/560; 221/30, 33, 45, 227

(56) References Cited

U.S. PATENT DOCUMENTS

| | | | | |
|---|---|---|---|---|
| 4,441,392 A | | 4/1984 | Deluca | |
| 6,092,451 A | * | 7/2000 | Granger | 83/335 |
| 6,378,725 B1 | * | 4/2002 | Granger | 221/30 |
| 6,415,948 B1 | * | 7/2002 | Granger | 221/30 |

FOREIGN PATENT DOCUMENTS

| | | |
|---|---|---|
| WO | 97 17715 | 8/1994 |
| WO | 97 24970 | 7/1997 |

* cited by examiner

*Primary Examiner*—Derris H. Banks
*Assistant Examiner*—Dmitry Suhol
(74) *Attorney, Agent, or Firm*—Wall Marjama & Bilinski LLP

(57) ABSTRACT

The invention concerns a dispenser comprising a device for lock-stopping the drum (6) arranged in the form of a shaped hook (18) mounted in free articulation on the pressing roll (11) shaft, said hook (18) being provided with a lower portion forming an arm **(18*b*) capable of being arranged opposite and resting on the belt (16) in the shaped groove (6*g*), said arm (18*b*) end having a projecting form designed to be in contact with the belt (16) and prevent the drum (6)** from rotating backwards after the material strip has been cut.

7 Claims, 4 Drawing Sheets

1
2
2a
3
4
5
6
6a
6b
6c
6f
7
8
9'
10
10a
10b
11
12
13
14
15
16
18
18e
18f
20

AUTOMATIC OR SEMI AUTOMATIC WIPING MATERIAL AND TOILET PAPER DISPENSER

BACKGROUND OF THE INVENTION

The invention relates to the technical field of apparatuses for dispensing paper wipes made of cellulose wadding, crêped paper and such like materials intended more particularly for wiping the hands of users of toilet paper.

Very many types of automatically operating wiper apparatuses exist and the applicant has developed several apparatuses of this type capable of dispensing strips of folded or unfolded material. These apparatuses, which give satisfactory service, are of the type comprising a moulded plastic housing accommodating in its upper part a feed reel of wiping material, a drum containing a cutter device with a serrated blade, and a presser means for feeding the strip of paper towards the drum and tensioning the paper. The cutter blade is pivoted inside the drum and moved by engagement of a toothed spur connected to the pivot of the cutter blade, and engaging with a fixed rack means positioned internally on one of the sides of the housing. The end of this drum is also provided with a cocking mechanism with a crank and return spring as described and illustrated in patent FR 76.04664.

SUMMARY OF THE INVENTION

In order to address certain difficulties of cutting encountered with recycled paper, especially thick unfolded paper, or folded paper comprising several thicknesses on top of each other, the applicant has developed a special new arrangement of the drum by modifying the initial circular section of the drum by altering its external profile by the formation of an extra thickness around part of its periphery. This improvement has been described in particular in French patent No. 277770 filed on Apr. 24, 1998. This modification of the circular section permits an intervention in certain stages of the operation of the apparatus and of the dispensing and cutting of a strip of paper, in such a way that improved tension of the strip of material is possible. More particularly, in accordance with that French patent application, around an angular sector of the periphery of the drum is a region of increased thickness defined between the edge of the opening for the passage of the cutting blade and a line corresponding to the axial plane with its edge on the axis at the end of which the crank is linked and attached, enabling cocking of the drum in preparation for the cut, the said complementary region being in contact with the presser means which is generally retractable, in terms of its position, on a floating mounting so as to absorb the changes in the thickness of the drum during the period of tension on the pulled strip of paper followed by cutting of the said paper.

The patent WO 9724970 moreover discloses a dispensing apparatus in which the drum comprises, around an angular sector of its periphery, a region of increased thickness which is capable of coming into contact with the presser means.

Because of the region of increased thickness formed on the drum around a given angular sector corresponding to the period of cocking of the drum for the cut, the applicant has observed that the pressure on the strip of paper after the cut drops after the region of increased thickness has been passed. The applicant has therefore observed that, owing to the reaction of the spring of the crank for the cocking of the drum, the latter has a tendency to roll back counter to its normal direction of rotation, carrying with it the strip of paper in a movement of partial retraction, whereupon the said strip vanishes and can no longer be reached by the operator.

The applicant's approach has therefore been to eliminate this problem by adding a device that controls the position of the drum inside the apparatus and prevents the said drum from turning backwards.

According to a first feature, the apparatus comprises a drum immobilizing device constructed in the form of a profiled hook pivoting freely on the shaft of the pressure roller, the said hook being constructed with a lower part forming an arm capable of being brought up to and against the belt in the profiled groove, and the end of the said arm having a projecting form for coming into contact with the belt and preventing the drum from rotating backwards once the strip of material is cut.

These features and others also will become clear in the remainder of the description.

BRIEF DESCRIPTION OF THE DRAWINGS

In order to provide a clear idea of the subject of the invention, illustrated in a non-restrictive manner in the figures of the drawings in which.

DESCRIPTION OF THE INVENTION

Figure 1:
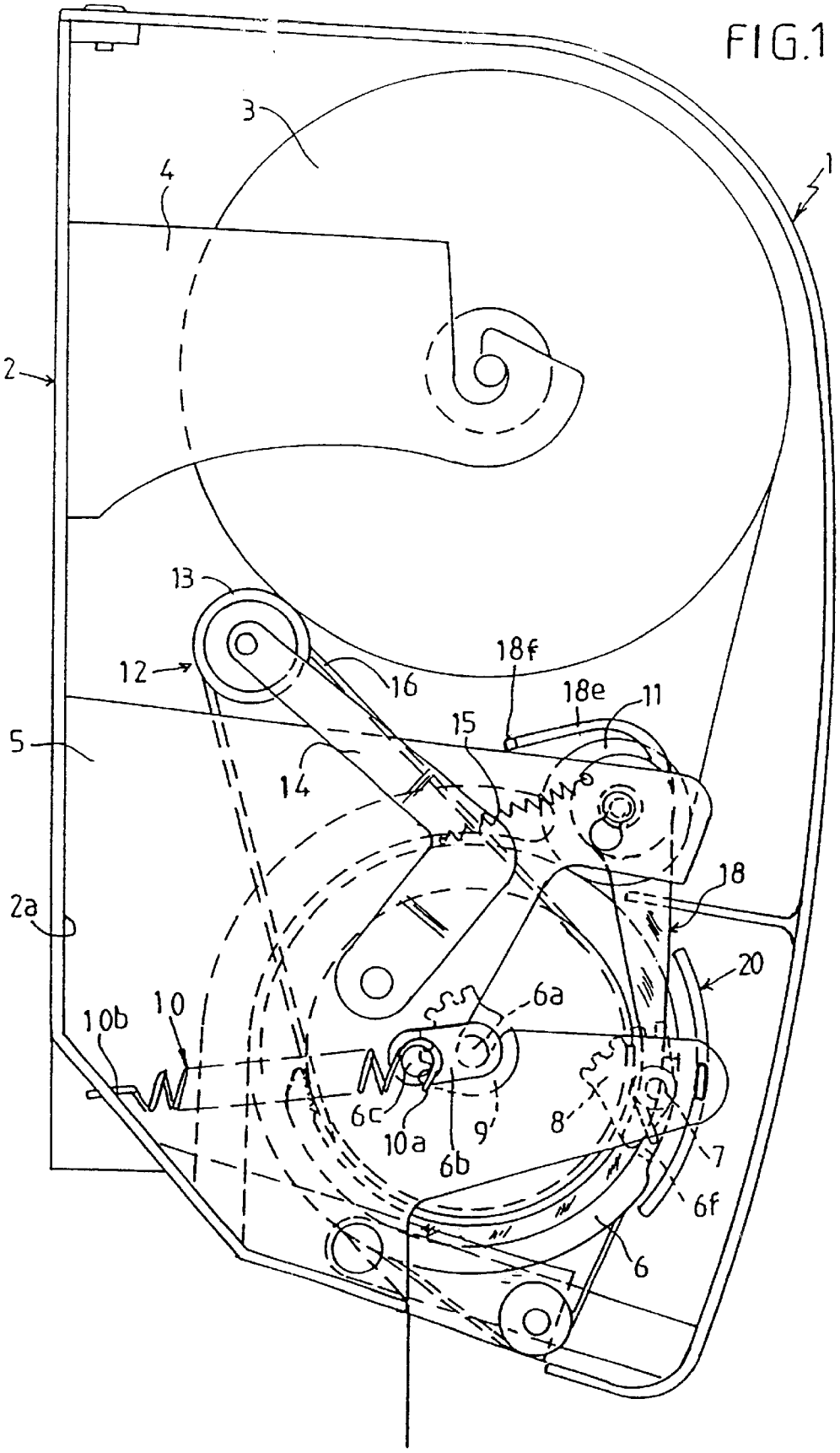
FIG. 1, is a side view of the dispensing apparatus according to the invention.
Figure 2:
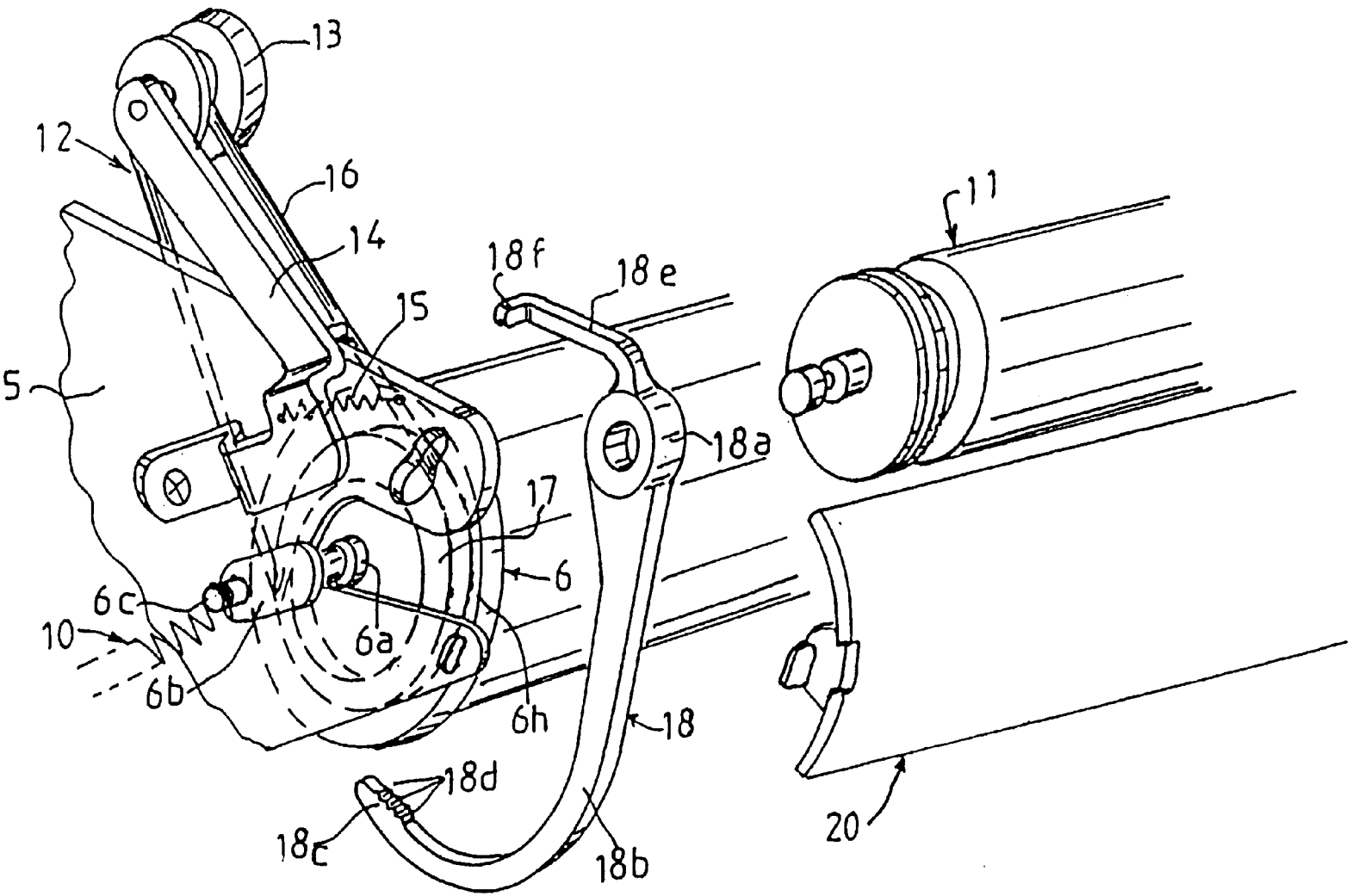
FIG. 2 is a perspective view illustrating a first embodiment of the device for controlling the position of the drum.
Figure 3:
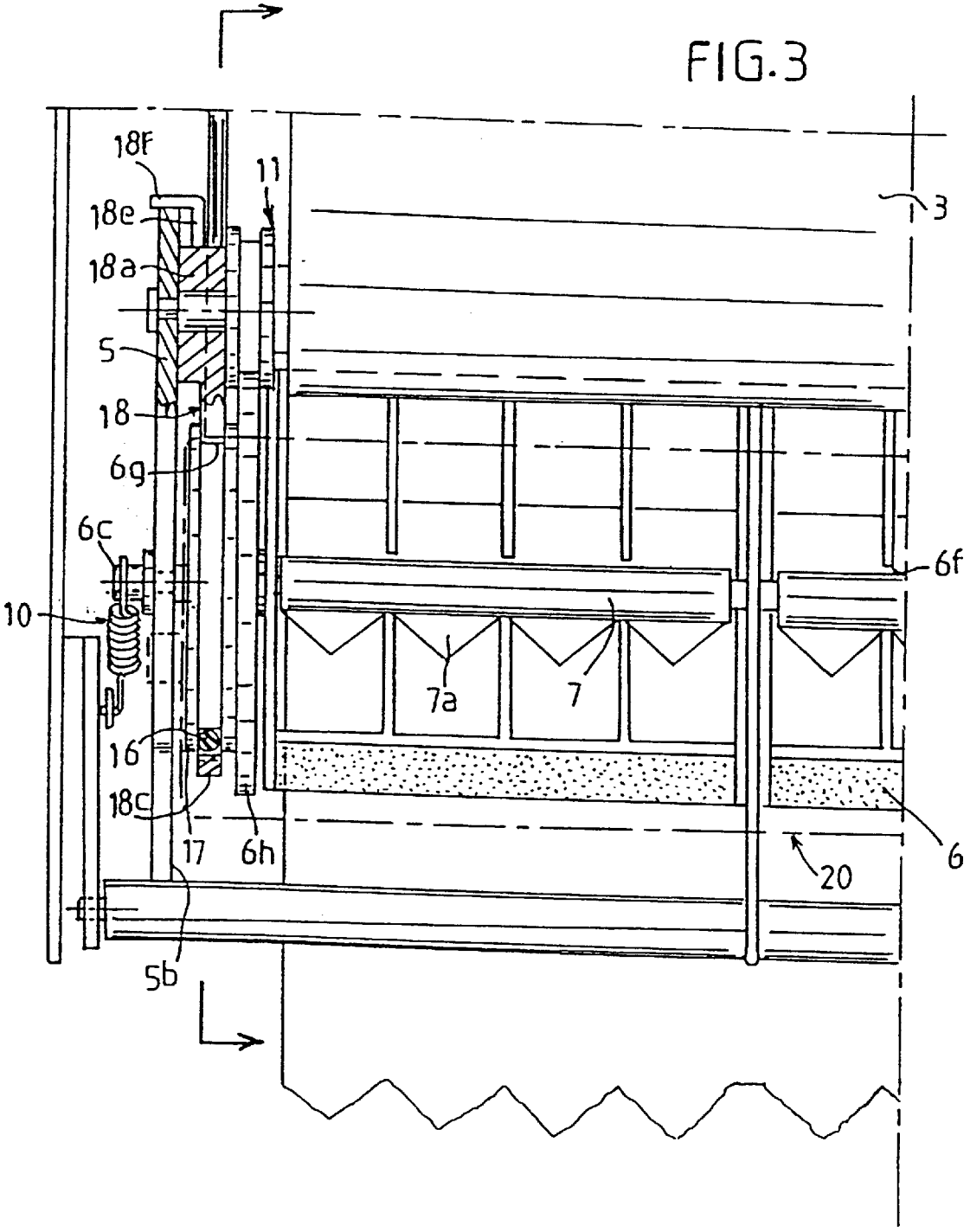
FIG. 3 is a partially sectioned front view of the dispensing apparatus.

In order to render the subject of the invention more concrete, it will now be described in a non-restrictive manner illustrated in the figures of the drawings.

The construction of an apparatus for dispensing hand towels and toilet paper denoted as a whole by (1) will now be rapidly and succinctly reviewed. The apparatus comprises a moulded plastic housing (2) able to accommodate in its upper part a feed reel (3) of wiping material or toilet paper held between upper side plates (4) fitted by rapid assembly or other means to the back of the housing. Lower side plates (5) are inserted and fixed by rapid assembly or other means, to the rear face **(2*a*) of the housing and are provided with slots allowing fixing and rapid assembly of the drum (6), which contains a cutter device (7) with a serrated blade (7*a*). This cutter device is pivoted as described earlier with a toothed spur mechanism (8) connected to the cutter blade which engages with a fixed rack (9) set on the inner side (5*b*) of the said side plate (5) of the housing. The drum has a longitudinal opening (6*f*) to allow the cutter blade to extend out. The drum is constructed in a known manner corresponding to the teaching of French patent 76.04664. One end is positioned centrally on one of the side plates of the housing while the other end has a shaft (6*a*) passing out through the other side plate to be engaged firmly in a corresponding slot in the side plate. The said shaft (6*a*) comprises a cranked shape (6*b*), the end (6*c*) of which forms a pin which provides the point of attachment for one end (10*a*) of a return and cocking spring (10). The latter has its other end (10*b*) fixed to the housing at the rear of the adjacent side plate. The presser means (11) in the form of a cylinder is the same length as the drum and can press on the latter when positioned between the aforementioned side plates (5**).

The dispensing apparatus also comprises a non-return device (12) for preventing run-back of the reel of wiping material, comprising an idler (13) contacting the reel of wiping materials; this idler is positioned between the side plates of the housing or on a cranked lever (14) acted upon by an elastic return means (15) fixed to the side plate (5) of the housing. A belt (16) can be run around the drum (6) and around the anti-looping idler (13). The drum is also provided at one end with a groove for positioning the abovementioned drive belt (16).

The drum comprises, around part of its periphery, a region of increased thickness described earlier. The groove (6*g*) housing the drive belt (16) with the idler (13) contacting the roll of the strip of paper to prevent looping, is defined in a known manner by the side wall of the drum (6*h*) and a side plate (17) mounted axially and parallel on the shaft of the said drum. The groove (6*g*) is of an appropriate section corresponding to the housing of the connecting drive belt (16).

It is now possible to describe the device forming the subject-matter of the invention, the object of which is to control the position of the drum and prevent the effect whereby the latter moves backwards during the period of relaxation of the elastic return means (10), which corresponds to the period of return of the drum after the crank lever (6*b*) has passed dead centre corresponding to the maximum extension of its return spring (10).

The device according to the invention is intended to introduce a drum immobilizing device (18), this device being constructed in the form of a profiled hook mounted on the shaft of the pressure roller (11) so as to rotate freely with respect to the latter. The said hook (18) thus comprises a central hub form (18*a*) fitting on the shaft of the pressure roller (11) beyond which it extends in a position such that the profiled lower part (18*b*) forming the arm of the hook can be brought up to and against the connecting belt (16) linking the drum (5) to the contact idler (13) on the paper roll, in the profiled groove (6*g*) described earlier.

This hook (18) comprises in this respect on its lower arm (18*b*) an end which is bent to correspond to the profile of the drum (5) and more or less surrounds the corresponding part of the belt (16). The free end (18*c*) of the said hook (18) has inward asperities (18*d*) or serrations which are profiled, and which do not prevent the drum from turning when the strip of paper is pulled because the said hook is held away as will be detailed later.

At the upper part (18*d*) of the said hook, beyond its hub, is a profiled elastic finger (18*e*) at the end of which is a bent-back catch (18*f*) which can rest on the side plate (5) adjacent to the housing of the apparatus. This catch (18*f*) rests on the said side plate (5) at all times.

The manner in which the assembly is put together gives the hook a certain elasticity making possible an appreciable elastic deformation of its lower arm (18*b*) as the drum rotates. When the drum is in the cocked position corresponding to the paper being pulled by the user, the belt linking the idler (13) in contact with the paper roll to the drum (6) tends to push the said arm (18*b*) of the said hook away. This situation corresponds to the region of contact between the pressure roller (11) and the portion of increased thickness formed on the drum. When the drum is in the situation of greatest cocking prior to the cut corresponding to maximum extension of the spring (10) attached to the crank (6*c*) what follows is the period of final rotation of the drum involving cutting of the strip of material; the pressure roller (11) exerts much less pressure on the drum once it has escaped from contact with the region of increased thickness, the catch (18*f*) and finger (18*e*) formed at the upper part of the hook (18) apply less force, and by elastic relaxation they will allow the lower part of the said hook to reposition itself against the abovementioned belt (16) so that there is contact between the serrated or projecting part of the free end of the hook and the said belt, thus preventing the drum from turning backwards.

As an additional feature a region (19) forming an immobilizing flat may be formed at the bottom of the groove to immobilize the belt (16), this flat being situated generally in line with crank dead centre. It will be possible for the belt (16) to be applied on the abovementioned flat, itself being pressed in by the serrated end of the abovementioned hook.

Figure 4:
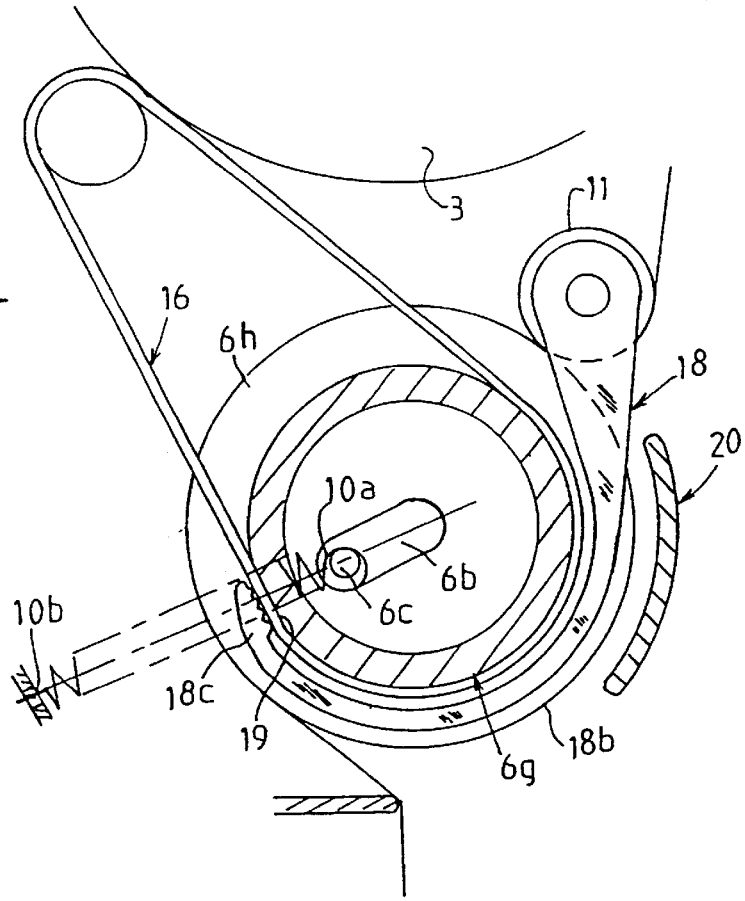
FIGS. 4 and 5 are partial views illustrating the positioning of the device for controlling the rotation of the drum by a second embodiment, during non-operation (FIG. 4) and operation (FIG. 5).
Figure 5:
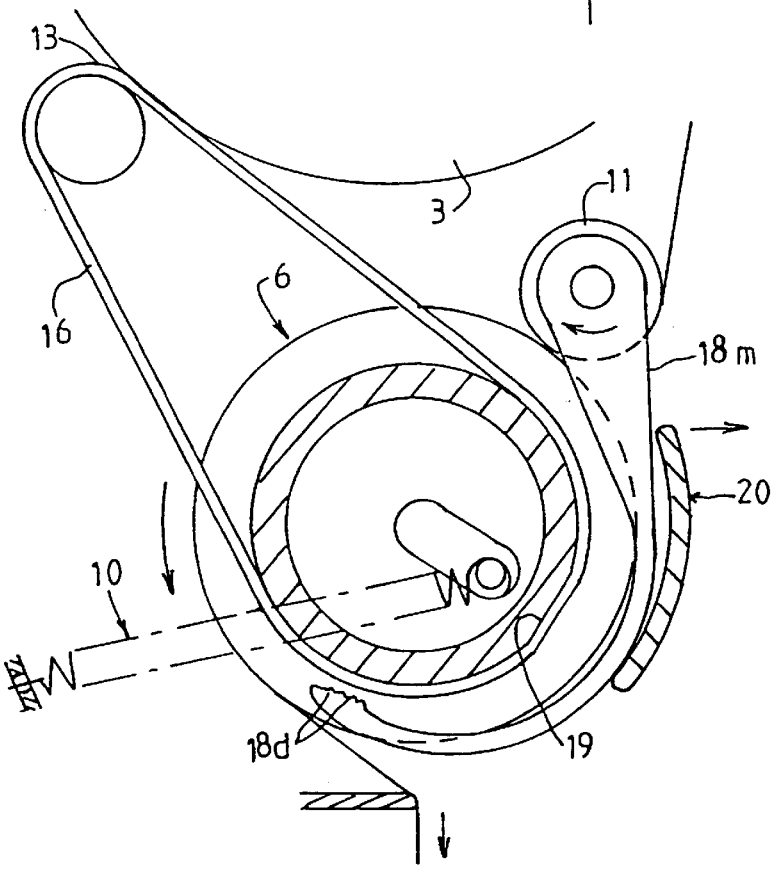

In an alternative embodiment illustrated in FIGS. 4 and 5, the drum rotation control hook (18) has no elastic finger at its upper part. Instead, in this embodiment the lower end (18*b*) of the said hook is profiled such that its front part (18*m*) can come up against a guard flap (20) fixed in position by snap action between the receiving side plates (5) of the drum. This flap exhibits a certain elasticity of deformation.

In this situation, referring to FIGS. 4 and 5, the initial rotation of the drum during the period when the strip of paper is being pulled, causes the strip of paper to unwind and moves the belt linking the contact idler (13) on the roll of paper to the drum (6). The belt (16) pushes away the serrated or projecting end (18*d*) of the hook (18) so that the front part (18*m*) of the said hook contacts the flap (20). During maximum cocking of the drum the said hook is in contact with the said flap with elastic deformation at its upper end. During the return of the drum corresponding to the cutting region, the decrease in pressure between the pressure roller (11) and the drum (6) has the effect that the said hook (18) is returned to its initial position under the relaxing of the deformation of the flap (20) and the hook (18) resumes its initial position, in particular returning to the region corresponding to the immobilizing flat (19) corresponding to locking of the said drum.

By means of the device of the invention the drum is made completely immobile. As a result it cannot roll backwards, so the strip of paper which is intended to be pulled by the user emerges conveniently from the dispensing apparatus.

The advantages will be clear from the description.

What is claimed is:

1. Apparatus for dispensing one of a wiping material and toilet paper, with automatic or semiautomatic operation, of the type comprising a housing (2) accommodating in its upper part a feed reel (3) of wiping material, a supporting drum (6) mounted between fixed internal side plates (5*a*) of the said housing, the said drum (6) having a slot (6*f*) for locating and pivoting a cutter device (7) with a serrated cutter blade (7*a*), and a presser means (11) pressing on the drum (6) in order to feed and tension the strip of paper passing between them, said cutter blade being pivotally attached inside the drum and moved by engagement of a toothed spur (8) connected to the cutter blade, and engaging with a fixed rack means (9) positioned on one of the side plates of the housing, said drum (6) being provided with a cocking means with a crank (6*b*) and return spring (10), and the drum (6) comprising, around an angular sector ($\alpha$) of its periphery, a region (17) of increased thickness capable of coming into contact with the presser means (11); the apparatus also comprising a non-return device for the wiping reel and a contact idler (13) in contact with the reel, and a belt (16) surrounding the said idler to produce a non-return action; and the drum being constructed with a profiled groove (6*g*) in which the said belt is accommodated, wherein the apparatus comprises a drum immobilizing device constructed in the form of a profiled hook (18) pivoting freely on the shaft of the pressure roller (11), said hook being constructed with a lower part forming an arm (18*b*) capable of being brought up to and against the belt (16) in the profiled groove, and the end of said arm having a projecting form for coming into contact with the belt and preventing the drum from rotating backwards once the strip of material is cut.

2. Dispensing apparatus according to claim 1, wherein the hook comprises a central hub form (18*a*) fitting on the shaft of the pressure roller (11) beyond which it extends in a position such that the lower profiled lower part (18*b*) forming the arm of the said hook can be brought up to and against the connecting belt (16) linking the drum to the contact idler on the paper roll.

3. Dispensing apparatus according to claim 2. wherein the hook exhibits a certain elasticity enabling an elastic deformation of its lower arm (18*b*) by the opposing pressure of the part forming the catch (18*f*) on the side plate (5), in such a way that it is disengaged when the belt (16) linking the contact idler (13) to the drum (6) is undergoing normal movement during pulling of the paper.

4. Dispensing apparatus according to claim 1, including at the upper part of the hook, beyond its hub, is a the side plate (5) adjacent to the housing of the apparatus, said catch (18*f*) resting on the side plate at all times.

5. Dispensing apparatus according to claim 1, such that when the pressure roller exerts less pressure on the drum once it has escaped from contact with the region of increased thickness, the catch (18*f*) and finger (18*e*) formed on the upper part of the hook again allow, by elastic relaxation, the projecting part on the free end of the hook to contact the belt and perform the braking function.

6. Dispensing apparatus according to claim 1. wherein a region (19) forming an immobilizing flat is formed at the bottom of the profiled groove (6*g*), said immobilizing flat being situated generally in line with crank dead center, being possible for the belt (16) to be applied under said immobilizing flat, itself being pressed in by the serrated or projecting end of the abovementioned hook.

7. Dispensing apparatus according to claim 1, wherein the hook possesses a lower part (18*b*) which is profiled such that front part (18*m*) of said lower part engages against a guard flap (20) fixed in position by snap action on the side plate (5) in which the drum is fitted, said flap being elastically deformable and being pushed when the serrated or projecting part of the hook disengages during the period of cocking of the drum.

* * * * *